United States Patent [19]

Campbell

[11] 4,130,003

[45] Dec. 19, 1978

[54] APPARATUS FOR MANUFACTURING HELICAL COILS

[76] Inventor: Maxwell S. Campbell, P.O. Box 134, Elkins, N.H. 03233

[21] Appl. No.: 809,926

[22] Filed: Jun. 24, 1977

[51] Int. Cl.[2] ..... B21F 3/04; B21F 3/10

[52] U.S. Cl. ..... 72/133; 72/137; 72/139; 72/142

[58] Field of Search ..... 72/133, 134, 135, 137, 72/138, 139, 142, 143

[56] References Cited

U.S. PATENT DOCUMENTS

| | | | |
|---|---|---|---|
| 458,115 | 8/1891 | Thomson | 72/135 |
| 1,981,950 | 11/1934 | Dodge | 72/137 X |
| 2,165,411 | 7/1939 | Peyton | 72/142 |
| 3,096,806 | 7/1963 | Root | 72/137 X |
| 3,959,066 | 5/1976 | Miller et al. | 72/133 X |

FOREIGN PATENT DOCUMENTS

| | | | |
|---|---|---|---|
| 198302 | 5/1908 | Fed. Rep. of Germany | 72/135 |
| 794 of | 1874 | United Kingdom | 72/135 |
| 445501 | 5/1975 | U.S.S.R. | 72/142 |

*Primary Examiner*—E. M. Combs

*Attorney, Agent, or Firm*—James E. Mrose

[57] ABSTRACT

In the automated manufacture of helical coils from sheet-metal blanks, each station of a rotatable set or carrousel of winding stations picks up a flat elongated blank from a stationary loader and securely grips and locks one end in an angled position against a slightly-tapered arbor whose subsequent rotation then causes the blank to become tightly wrapped helically about the arbor while retractable ironing plates stretch-form it and while a second locking mechanism positions the opposite end of the blank untl wrapping is completed. The single thrust of a shaped actuating rod causes a locking member to both position itself and move into a clamping relation with the one end of the blank and the arbor, and both the second locking mechanism and the ironing plates are of toggle-type constructions which enable them to hold securely until positively released. Arbor rotation, and operation of the second locking mechanism, are powered in response to motion of the carrousel relative to stationary structure, and fluid-powered actuators serve to drive the thrust rod and ironing plates under control of detectors responding to angular positions taken up by the carrousel.

11 Claims, 9 Drawing Figures

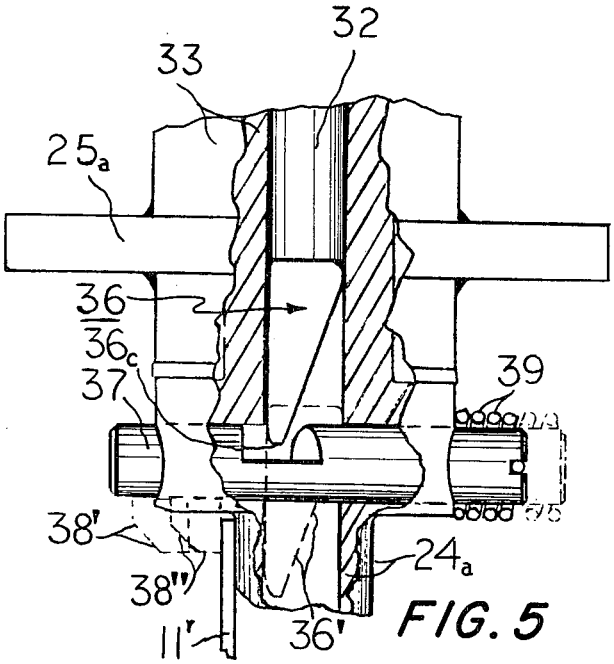
FIG. 5
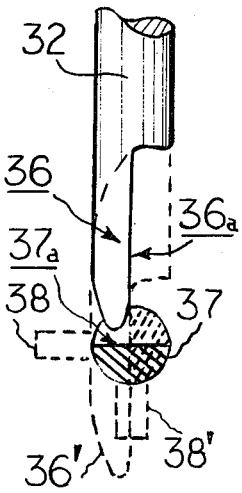
FIG. 6
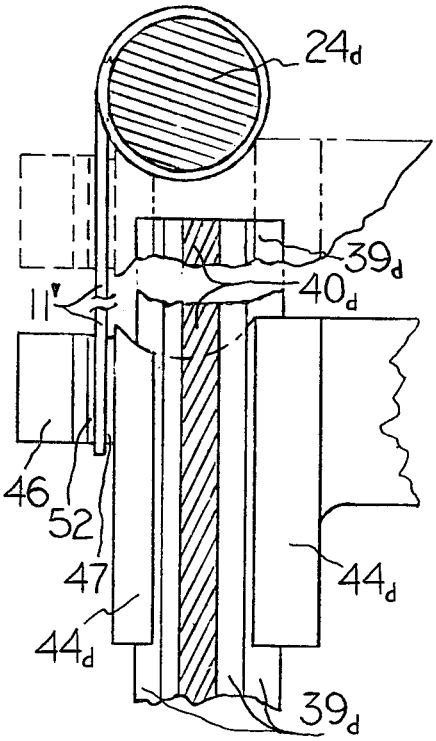
FIG. 9
FIG. 8
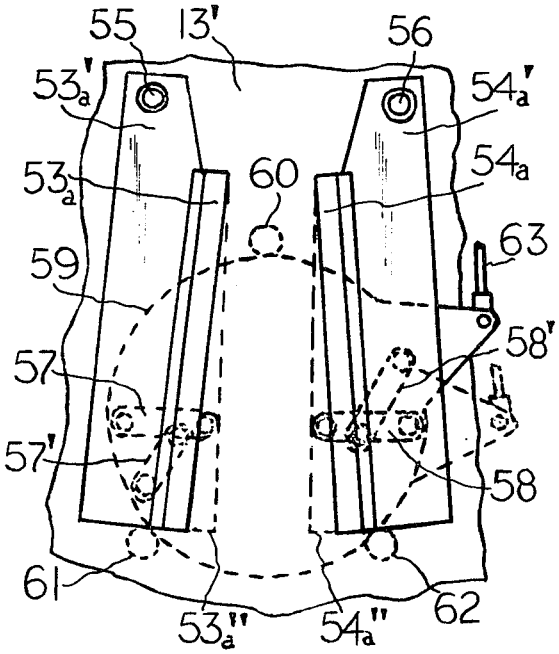

APPARATUS FOR MANUFACTURING HELICAL COILS

BACKGROUND OF THE INVENTION

The present invention relates to improvements in the manufacture of helical coils, and, in one particular aspect, to novel and improved apparatus for the reliable automated manufacture of helical anchor-bolt coils from pre-cut flat metal blanks. Such coils are useful as elements of expansion-type fasteners, or anchor bolts, like those of my U.S. Pat. No. 3,881,393, dated May 6, 1975.

Helical coils are commonly produced from continuous stock, whereby a sustained hold or grip and control of the material can readily be maintained until each desired helix is fashioned and cut off as a separate coil. In some instances, however, it is a handicap that the cross-section of continuous stock cannot conveniently be a variable one, and the designer and manufacture must accept that limitation unless willing to resort to hand-worked shaped blanks and non-automatic coil forming. Stock in the form of separate flat pieces, or blanks, presents a classic production dilemma, because of problems associated with handling, conveying, gripping and feeding such parts during processing. In the case of blanks suitable for formation of coils used in expansion fasteners according to my said U.S. Pat. No. 3,881,393, the individual flat sheet-metal pieces of stock are tapered in width and have no flanges, perforations or other features which might assist in their handling; however, such blanks are nevertheless processed automatically into closely-controlled helical coil form in accordance with the practices disclosed herein and with the aid of apparatus constructed according to the present teachings.

SUMMARY

By way of a summary account of practice of this invention in one of its aspects, a stack of elongated, narrow and tapered sheet-metal blanks is disposed at a stationary feeding or loading site, whence the individual blanks may be delivered, in succession, into the grasps of different ones of a multiplicity of work stations located in equi-angular distribution about the periphery of a drum-like support which is rotated at substantially constant speed about a vertical central axis. The carrousel array of work stations is turned by a suitable power source, such as an electric motor, and each work station features a vertical arbor or mandrel about which a blank may be wrapped helically as the arbor is rotated by gearing which meshes with a relatively-stationary ring-gear or rack. Each station is further provided with a pair of gripping and releasable locking mechanisms, one located at an upper arbor position where winding is to commence and another located alongside a lower arbor position where winding is to be completed. The upper locking mechanism includes a separately-powered tooth which is both rotated and moved laterally to bite one end of a blank into firmly-locked abutting relation with the arbor, and the lower locking mechanism includes jaws which hold down the other end of the blank after being toggle-actuated by camming as the carrousel moves and which are slidable radially to allow the blank to be drawn toward the arbor as winding progresses. Once one end of a blank has been locked with an arbor, a pair of oppositely-disposed plates is separately powered to closure about the arbor, where the plates "iron" or stretch-form the blank during its coiling. Upon completion of the coiling, the side plates and locking tooth are seaparately actuated to release the coil, and the locking jaws by then have fallen open as the blank end was withdrawn from them in a substantially radial direction; further a return spring associated with the locking jaws mechanism will also by then have re-set that mechanism to a radially outer position where it may be re-loaded.

Accordingly, it is one of the objects of the present invention to provide for novel and improved automated manufacture of helical coils wherein individual flat blanks are gripped at opposite ends and are oriented and caused to wrap themselves about a forming member with a predetermined pitch of winding and are ironed and released as finished coils.

A further object is to provide unique and advantageous apparatus for reliable automated manufacture of helical coils from pre-cut sheet-metal blanks, including rotated arbors associated with blank-holding mechanisms which cause the blanks to wrap themselves into helical coils of desired pitch and dimensions.

Still further, it is an object to provide novel automatic coil-winding apparatus in the form of a rotated carrousel of work stations each of which picks up a pre-cut flat coil blank, locks one end to a rotated arbor and the other to a movable pitch-regulating locking mechanism, and wraps and stretch-forms the blank to a desired helical form before releasing it, and to provide unique and useful locking mechanisms for the handling of flat blanks and the like.

BRIEF DESCRIPTION OF THE DRAWINGS

Although the aspects of this invention which are believed to be novel are set forth in the appended claims, additional details as to preferred practices and as to the further objects, advantages and features thereof may be most readily comprehended through reference to the following description taken in connection with the accompanying drawings, wherein:

FIG. 5 is a partly cross-sectioned detail, in enlargement, of an arbor locking mechanism such as appears in the FIG. 4 view of a work station;

FIG. 6 is an end view of the actuating rod and locking-mechanism shaft shown in the detail of FIG. 5, together with dashed linework representing their alternative positioning during use;

FIg. 8 depicts a pair of ironing or stretch-forming shoes such as are used at each of the work stations such as those shown in FIGS. 2, 3 and 4, together with a dashed-linework representation of an associated actuating mechanism; and FIG. 9 is a view from above, showing further details of a blank-locking mechanism and cooperating slide rail used to position the lower ends of coil blanks being fashioned by the apparatus as shown in FIGS. 2, 3, 4 and 7.

DESCRIPTION OF THE PREFERRED EMBODIMENTS

Figure 1:
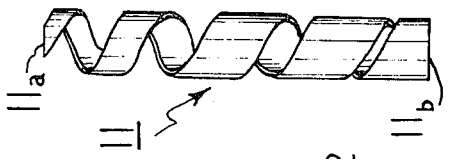
FIG. 1 is a pictorial view of a helical expansion-fastener coil such as may be advantageously fashioned automatically according to this invention.

The helical coil spring 11, in FIG. 1, is of a type which is useful in the construction of expansion fasteners, such as those described in my U.S. Pat. No. 3,881,393. For those purposes, the coil 11 is fashioned by helically winding a flat strip of a suitable spring-metal such that the turns are axially spaced, and each successive turn, from top to bottom, is of axially-longer dimensions, as shown. Further, the top end 11*a* and bottom end 11*b* preferably lie in planes transverse to the direction of axial elongation of the coil, also as shown.

Figure 2:
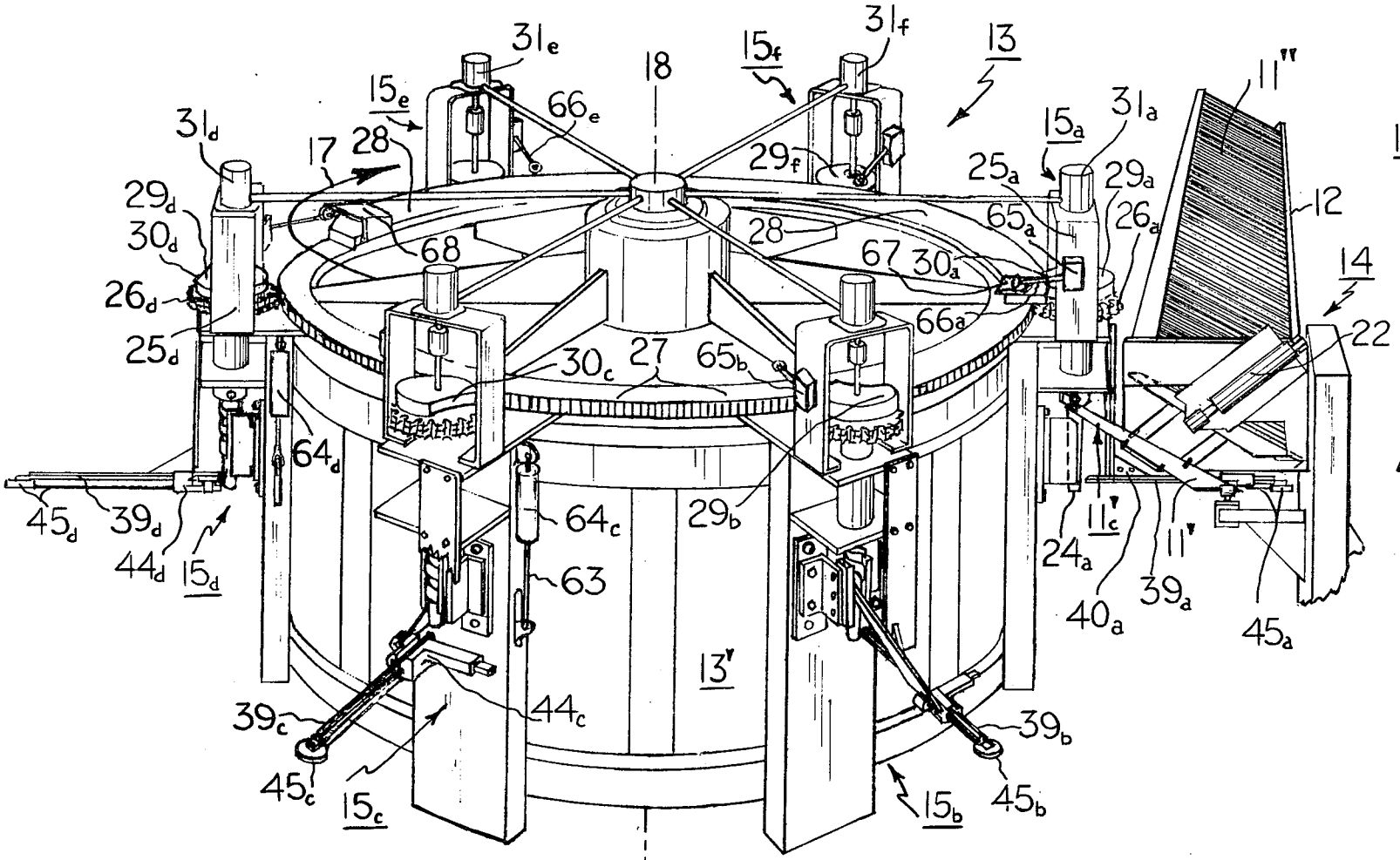
FIG. 2 provides a pictorial representation of an automated helical-coil manufacturing apparatus constructed in accordance with the present teachings, including an associated blank-feeding installation.
Figures 3, 4, 7:
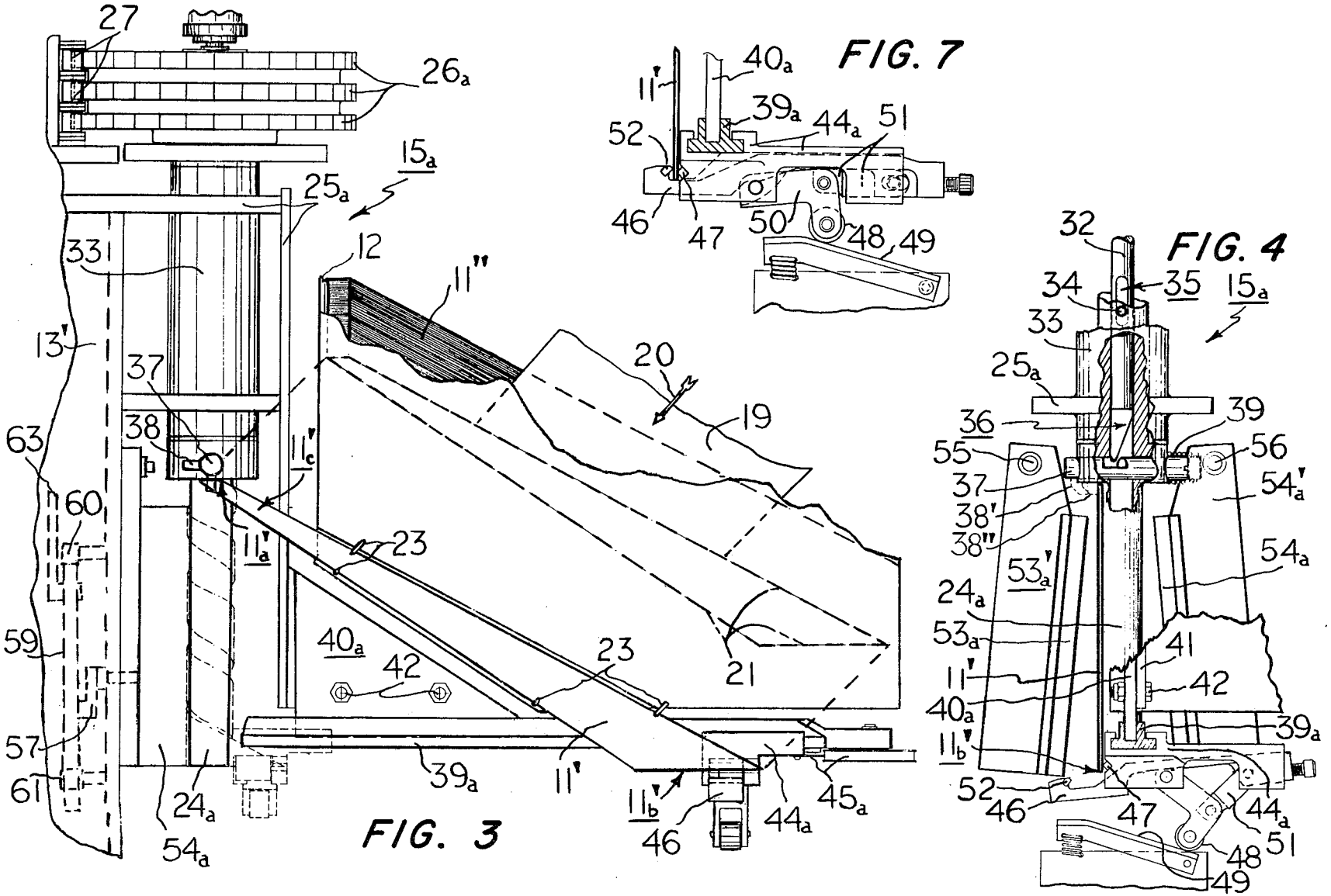
FIG. 3 is a view, on an enlarged scale, of a work station and blank-feeding installation such as appears in the apparatus of FIG. 2.
FIG. 4 is a front end view, with portions broken away to expose certain structural details, of a work station such as is illustrated in FIGS. 2 and 3.
FIG. 7 illustrates one of the blank locking mechanisms of FIG. 4 in its cammed and toggle-held gripping condition.

The flat strip or blank, 11', from which a coil such as 11 may be wrapped, has a distinctive trapezoidal configuration such as appears in FIGS. 2 and 3, with the narrower upper end, 11*a'* being parallel with the lower wider end, 11*b'* (FIG. 3). There is a high degree of elongation, and the width of the blank increases progressively from the upper to lower end. FIG. 2 illustrates a sloping chute or conveyor 12, in which a stack of such blanks, 11", is readied for feeding of the blanks one-at-a-time to work stations of a drum-like rotatable carrousel 13 as such stations become radially aligned with the stationary blank-loading installation 14. As is illustrated in FIGS. 2 and 3, a blank 11' which has been poised for loading onto a work station has a substantial length 11*c* extending freely and inclined upwardly so that the end 11*a'* may be engaged by an arbor of a work station as it turns past installation 14. For the latter purpose, each of the multiplicity of like work stations, such as the six stations 15*a*–15*f*, is carried at equally-spaced positions on the outer periphery of a cylindrical or drum frame, 16, such that they may be moved past the blank-loading installation in succession as the frame is rotated in the direction of arrow 17 about a vertical axis 18—18 (FIG. 2) by suitable motive means such as an electric motor (not shown). Preferably, the lowermost or first blank in the conveyor 12 is automatically ejected from the conveyor, downwardly and outwardly, each time one is needed for the fresh loading of a work station, although the same thing may be accomplished manually in an alternative arrangement. When the ejection is automatic, a narrow blade or plate 19 (FIG. 3) of about the thickness of a single blank is propelled in the intended direction, represented by arrow 20, and drives the first blank, represented by dashed linework 21, to the loading position, responsive to the force exerted by a double-actuating pneumatic ejection piston-cylinder unit 22 (FIG. 2). The latter unit is actuated to drive blade 19 downwardly when a work station approaches installation 14, by a suitable position-responsive switch not shown, and to retract the blade and hold it in readiness for another ejection thrust after a work station leaves the loading position of installation 14. When a blank is driven to or otherwise placed in the poised loading position shown for blank 11' in FIGS. 2 and 3, it is held there, relatively lightly and releasably, by the edge-clamping actions of spring fingers such as 23, or the like; sidewise forces will dislodge the blank, as intended, once a work station advances to meet it and pick it up from its poised loading position.

Each of the work stations, 15*a*–15*f*, includes a vertically disposed blank-coiling arbor, 24*a* et seq., held in a framework, 25*a* et seq., and rotated by a pinion-gear unit, 26*a* et seq., which meshes with and is turned by its movement relative to an arcuate stationary rack or partial ring gear structure 27 as the carrousel is rotated about axis 18–18. The engagements between a pinion unit, such as 26*a*, and the rack structure 27 begin as a blank is loaded at the site of installation 14, whereupon an arbor such as 24*a* begins to turn for purposes of coiling a blank; however, after a blank is fully coiled into the desired helix, such as may occur when it reaches the site of discharge station 15*d*, the arbor need not be turned in the same way and the rack structure is discontinued from there fully around to the loading site. Nevertheless, for purposes of setting the arbor accurately in a predetermined angular orientation in its framework, so that it may properly grasp and hold a blank, a camming action is developed between an arcuate cam member 28 and an arbor-mounted cam follower, 29*a* et seq., having an arcuate cut-out, 30*a* et seq., which matches the curvature of cam member 28 and thus forces the arbor to be angularly set in a desired orientation for pick-up of a blank at the site of installation 14. Cam member 28 is of course effective over the arcuate region, angularly about axis 18—18, where ring-gear unit 27 is not effective to turn the arbor, and vice versa.

With its arbor angularly set, each work station is turned with the carrousel until its arbor, such as 24*a* (FIG. 3), is disposed at the back of the upper end of a poised blank, such as 11'. When that occurs, a switch (not shown) responds to the relative positioning of the work station next to the installation 14 and causes the double-acting piston-cylinder unit 31*a*, of units 31*a* et seq., to depress a thrust rod 32 (FIG. 4) within a mount 33 for the arbor 24*a*. That thrust rod is keyed angularly by a pin 34 which passes through a slot 35, such that a shaped end 36 of the thrust rod may coact in a double cam-like way with a cross-piece of pin 37 extending transversely through the mount or head 33 for the arbor. Cross-piece 37 has a radially-projecting tooth 38 (FIG. 3) integral with it on one side at one end and projecting outside of the head 33, and a spring 39 (FIGS. 4, 5) at the opposite end thereof and also outside of the head 33 normally urges the tooth to a horizontal and outer position away from the arbor. For a blank-locking or -biting action, the tooth 38 must be rotated 90° to hang downwardly and must also be pulled inwardly toward the arbor 24*a*, so that the free upper end of blank 11' will become firmly clamped to the arbor. Dashed line-work 38' (FIGS. 4, 5) characterizes the downward outer locus of the tooth 38, and dashed line-work 38" characterizes the inwardly-retracted position of the tooth. The reversed tooth motions must occur later, as the finished coil is released. The needed 90° rotation and inward sliding motion of toothed cross-piece 37 are both achieved by interference and camming actions as the shaped end 36 of thrust rod 32 is depressed upon actuation of piston-cylinder unit 15*a*. Cooperative shaping of an intermediate portion of cross-piece 37 is also involved; specifically, the cross-piece is provided with a substantially hemicylindrical cross-section, having a flat 37*a* as shown in FIGS. 5 and 6, and it is also provided with an oblique or sloped wedging surface 37*b* inclined longitudinally of the cross-piece, as shown in FIG. 5. Shaped end 36 of the thrust rod is flat on one side, 36*a*, where it may abut with flat 37*a* after its descending off-center point 36*c* has forced the cross-piece to turn 90°; the two abutted flat surfaces then serve to lock the cross-piece in the quarter-turned position shown by linework 38'. Thereafter, further downward thrust of rod end 36 results in wedging or camming of its laterally-inclined edge 36*b* with the complementarily-inclined oblique surface 37*b* of the cross-piece, whereupon the cross-piece is wedge longitudinally to move the tooth 38 to the position 38" where it bites and locks the end of blank 11' with the arbor so long as the thrust rod end 36 is held in its fully-depressed position shown by dashed linework 36' (FIGS. 5 and 6). Needed locking forces are maintained with little power, and variations in thicknesses of the blanks are accommodated as the thrust rod merely descends until it can move no further in that direction.

It is also important that a blank being picked up at the loading site be restrained and oriented at its tail end, more remote from the arbor of a work station. In particular, the tail end of each blank must be prevented from being pulled upwardly, and must be prevented from turning with the arbor as it attempts to wrap a blank about itself as a coil, and must be held at an angle of inclination appropriate to the winding of a coil with a specific pitch. For such purposes, each work station is supplied with a guide rail, 39*a* et seq., extending radially outward in relation to the carrousel axis 18—18 and supported at an appropriate adjustable angle relative to the horizontal by a triangular gusset plate, 40*a* et seq., which is adjustable in relation to a frame-supported plate 41 (FIG. 4) by way of bolts 42 (FIGS. 3 and 4) fitting loosely in one of the abutted plates. The angular adjustment thus afforded in one which affects pitch of the helically-wound coils, and is therefore an important feature when such pitch variations are to be accommodated. The guide rails 39*a* et seq., carry slidable locking mechanisms, 43*a* et seq., which have bodies 44*a* et seq. interfitting therewith and which therefore can move from radially outer positions, to which they are biased by a coiled cable and return-spring mechanism, 43*a* et seq., disposed at the radially outer ends of the guide rails. Each of the slidable locking mechanisms mounted on the bodies 44*a* et seq. is essentially a "toggle" device which will grip and hold the rear lower end of a blank as the loading onto a work station takes place. One of the elements of each toggle device is a lower jaw member, 46 (FIGS. 3, 4, 7), which is in a normally-open lowered position to begin with, and therefore allows the lower edge 11*b*' of a blank to clear it as a blank is being approached by a work station (FIG. 4) and enables the lower rear side of the blank to abut with a horizontal tungsten-carbide tooth 47 which is the effective part of a second jaw. Thereafter, as the work station continues to turn, the roller 48 of an actuating link rides up a stationary cam surface 49 at the site of the loading installation 14 (FIG. 4) and is moved to a "closed" position, as shown in FIG. 7, where the pivoted link 50 pushes the cooperating link 51 and thereby forces the lower jaw member 46 both backwardly and upwardly. In the course of that "toggle" action, the tungsten-carbide horizontal tooth 52 of lower jaw member 46 bites the front side of the blank, at an offset position slightly above that at which tooth 47 makes its bite, such that their joint bite (FIG. 7) is tightened as any force tends to pull the blank upwardly. Jaw member 46 also provides a horizontal rest and guide for the bottom edge of the blank just before the jaw teeth complete their bite. The over-center toggle mechanism tends to hold itself locked closed until the blank has been nearly fully wound upon the arbor, at which point the coiling action tends to draw the blank material substantially radially and horizontally through the jaws and horizontal teeth, with relatively little resistance being offered by the teeth. Once the blank is thus withdrawn, the lower jaw is free and then drops under influence of gravity, and links 50 and 51 and roller 48 return to their initial positions (FIG. 4), in readiness for loading of another blank as the work station thereafter returns to the site of installation 14. The slidable locking mechanism will have been drawn radially inward along its cooperating guide rail until it is close to the arbor, before the tail end of the blank is withdrawn horizontally from between the jaw teeth, a condition shown in FIG. 9 in dashed linework, and at work station 15*d* in FIG. 2. Upon thus becoming free from its locking, the slidable locking mechanism is pulled to its radially outermost position once again, by the cable and coiled return-spring mechanism 45*a*.

As soon as a blank is picked up and locked both to the arbor and the tail-locking mechanism, coiling commences around the arbor, due to rotation of the latter attendant upon traversal of the stationary ring gear by the arbor pinion gear. Preferably, the blanks are coiled about the slightly-tapered arbors while simultaneously being "ironed" or stretch-formed by side plates 53*a* et seq. and 54*a* et seq. The latter pairs of side plates are held by movable shoes 53*a*' et seq. and 54*a*' et seq. and 54*a*' et seq. which are tiltable about upper pivots 55 and 56 (FIGS. 4 and 8), the tilting being required so that the plates may be withdrawn or retracted from the finished coils to allow the latter to be released from the arbors. Each cooperating pair of ironing shoes, with side plates, is actuated by another toggle-type assembly involving links 57, 58 (FIG. 8) between their lower ends and a common circular plate, 59. As shown in FIG. 8, and in FIG. 3, the further toggle assembly is in dashed linework, because hidden behind the framework 13' of the carrousel. Three rollers, 60,61 and 62, support plate 59 for limited angular movements induced by its lever-arm extension and a rod 63 actuated by a double-acting piston-cylinder unit such as units 64*c* and 65*d* in FIG. 2. In the working condition, with the side plates closed to the positions marked by dashed linework 53*a*" and 54*a*" in FIG. 8, the actuating links 57 and 58 are disposed substantially horizontally and diametrically opposite one another, where they can most readily withstand the "ironing" loadings. Turned slightly counter-clockwise, upon lifting of rod 63 to the upper position shown for piston-cylinder unit 64*d* in FIG. 2, the links 57 and 58 turn to the positions 57' and 58' shown in FIG. 8 and draw the shoes and ironing plates apart, so that a helical coil which has been wound and ironed between them may be allowed to drop off the arbor (not shown in FIG. 8, to promote clarity). The shoes and plates are drawn together just as soon as coil winding commences, and this occurs as the result of a switch, 65*a* et seq., on each work-station frame being actuated by its lever arm, 66*a* et seq., as the latter rides up a stationary cam 67 disposed near the loading installation 14. When winding is completed, the shoes and plates are separated, as the result of the same switch having its lever arm depressed by a second stationary cam 68 disposed near a coil-discharge site, such as that of station 15*d* in FIG. 2. The switches 64*a* et seq. are of known types, pneumatic or electrical, which are suitably in control of the aforementioned actuations of the piston-cylinder units such as 64*c* and 64*d*.

In other embodiments, the blanks being processed may be of uniform or irregular widths, and hydraulic or electrical actuators may be used in place of the illustrated pneumatic devices, and the automatic or semi-automatic controls and detectors may be mechanical, fluid or electrical, and so forth. Accordingly, it should be understood that the specific embodiments and preferred practices described herein have been presented by way of disclosure rather than limitation, and that certain departures may be accomodated within the spirit and scope of this invention in its broader aspects and as set forth in the accompanying claims.

I claim:

1. Apparatus for the manufacture of helical coils from substantially straight discrete blanks of metal stock, comprising an arbor rotatable about its longitudinal axis, means for clamping one end of a blank to said arbor for rotation thereby in a skewed relationship therewith, said clamping means being mounted for rotation with said arbor about said axis, and said clamping means including a clamp member disposed on the outside of said arbor and actuatable to move from a first position at which it does not interfere with placement of the said one end of a blank against said arbor to a second position at which it overlies the said one end of a blank placed against said arbor and thence to a third position at which it clamps the said one end of a blank tightly against said arbor, means for locking the other end of a blank against motion in the longitudinal direction of said axis and angularly about said axis while allowing movement of said other end in a radial direction relative to said axis, means for rotating said arbor and clamping means about said axis, and means holding said locking means in a fixed angular relation about said axis, whereby rotation of said arbor about said axis causes a blank clamped thereto to become wrapped helically about said arbor with pitch as determined by the positioning and holding of the blank relative to said arbor by said clamping means and locking means.

2. Apparatus for the manufacture of helical coils as set forth in claim 1 wherein said clamping means includes a thrust rod keyed with and slidable longitudinally within a longitudinal opening at one end of said arbor, said rod having an end projecting out of said arbor and a shaped end within said arbor, said shaped end having a first flat surface substantially parallel with said axis and a second surface inclined and substantially normal in relation to said first surface, said shaped end having an off-center point, and a generally-cylindrical cross-piece rotatable and slidable within an opening in said arbor transverse to and intersecting with said longitudinal opening, said clamp member being fixed with one end of said cross-piece and extending radially therefrom, spring means normally urging said cross-piece angularly and longitudinally and thereby normally urging said clamp member to said first position, said cross-piece having a substantially hemicylindrical cross-section at an intermediate position within said arbor disposed for off-center engagement and 90° rotation by said off-center point of said thrust rod as said thrust rod is thrust into said arbor, said first flat surface and the flat surface of said cross-piece at the site of said hemicylindrical cross-section being disposed to abut one another and thereby to hold said cross-piece and said clamp member in a 90° rotated position, and said cross-piece having an inclined surface normal to and next to the flat surface thereof and inclined in substantially parallel relation to said second surface of said thrust rod whereby engagement of said inclined surfaces upon thrust of said rod into said arbor causes said cross-piece to move longitudinally and carry said clamp member to said third position.

3. Apparatus for the manufacture of helical coils as set forth in claim 2 further including means for forcing said thrust rod into and for at least partly retracting said thrust rod from said arbor as a blank is being loaded onto and released from said arbor, respectively.

4. Apparatus for the manufacture of helical coils from substantially straight discrete blanks of metal stock, comprising an arbor rotatable about its longitudinal axis, means for clamping one end of a blank to said arbor for rotation thereby in a skewed relationship therewith, means for locking the other end of a blank against motion in the longitudinal direction of said axis and angularly about said axis while allowing movement of said other end in a radial direction relative to said axis, said means for locking the said other end of a blank including a substantially straight guide rail, means mounting said guide rail in substantially radial relation to said axis at a fixed angular position about said axis, a first jaw body fitted with said guide rail to slide radially therealong and having tooth means along one side disposed for engagement with one side of a blank near the other end thereof, a jaw member mounted upon said jaw body for sliding movement therewith and for jaw movement in relation thereto, said jaw member having tooth means along one side disposed for jaw movement therewith into biting engagement with the other side of a blank near the said other end thereof, the tooth means of saw jaw member normally being widely separated from the tooth means of said jaw body to allow entry of the said other end of a blank therebetween, an over-center toggle mechanism supported by said jaw body and connected to move said jaw member in a jaw movement relative to said jaw body which develops said biting engagement, said toggle mechanism having an actuating link the movement of which in one sense produces said jaw movements and biting engagement, means for actuating said link as a blank is being loaded onto said arbor for coiling, means for rotating said arbor and clamping means about said axis, and means holding said locking means in a fixed angular relation about said axis, whereby rotation of said arbor about said axis causes a blank clamped thereto to become wrapped helically about said arbor with pitch as determined by the positioning and holding of the blank relative to said arbor by said clamping means and locking means.

5. Apparatus for the manufacture of helical coils as set forth in claim 4 wherein each of said tooth means extends substantially parallel with said guide rail, whereby material of a blank held by biting engagement with said tooth means may be pulled from between said tooth means by winding forces which are substantially parallel with said tooth means and guide rail as wrapping of a blank upon said arbor is being finished.

6. Apparatus for the manufacture of helical coils as set forth in claim 5 wherein the bite of said tooth means of said jaw member overhangs that of said tooth means of said jaw body, thereby producing an increased biting and holding action as material of a blank therebetween is pulled in direction normal to said guide rail by winding forces.

7. Apparatus for the manufacture of helical coils as set forth in claim 4 wherein said means mounting said guide rail includes adjusting means for controlling the angular slope of said guide rail in relation to the axis of rotation of said arbor, whereby the pitch of helical winding of a blank about said arbor is controlled.

8. Apparatus for the manufacture of helical coils from substantially straight discrete blanks of metal stock, comprising an arbor rotatable about its longitudinal axis, means for clamping one end of a blank for rotation thereby in a skewed relationship therewith, means for locking the other end of a blank against motion in the longitudinal direction of said axis and angularly about said axis while allowing movement of said other end in a radial direction relative to said axis, means for rotating said arbor and clamping means about said axis, means holding said locking means in a fixed angular relation about said axis, flat plate means closely alongside said arbor and fixed in angular relation to said axis, said flat plate means being disposed to engage and stretch-form the material of a blank as it is being wrapped helically about said arbor, said flat plate means comprising a pair of plate-mounting shoes one opposite the other with said arbor in between, each of said shoes having a flat plate thereon disposed alongside said arbor, means mounting said shoes for movement of the plates thereon toward and away from said arbor, and means actuating said shoes to move said plates away from said arbor when a coil blank is to be released from said arbor and to move and hold said plates toward said arbor when a blank is being wrapped into a helical coil about said arbor, whereby rotation of said arbor about said axis causes a blank clamped thereto to become wrapped helically about said arbor with pitch as determined by the positioning and holding of the blank relative to said arbor by said clamping means and locking means.

9. Apparatus for the manufacture of helical coils from substantially straight discrete blanks of metal stock, comprising an arbor rotatable about its longitudinal axis, means for clamping one end of a blank to said arbor for rotation thereby in a skewed relationship therewith, means for locking the other end of a blank against motion in the longitudinal direction of said axis and angularly about said axis while allowing movement of said other end in a radial direction relative to said axis, means for rotating said arbor and clamping means about said axis, means holding said locking means in a fixed angular relation about said axis, whereby rotation of said arbor about said axis causes a blank clamped thereto to become wrapped helically about said arbor with pitch as determined by the positioning and holding of the blank relative to said arbor by said clamping means and locking means, said arbor, clamping means, locking means and means holding said locking means comprising a first work station, and further comprising a plurality of work stations substantially the same as said first work station, means mounting said work stations in a circular array angularly spaced from one another and with the arbors of said stations disposed substantially vertically about the outside of said array, means for rotating said mounting means about a substantially vertical central axis of said array, stationary loading means located at one angular position about said central axis and radially outwardly of the circular path of travel of said arbors in said array, said loading means having means for poising a blank for engagements by the clamping means and locking means of a work station as it is rotated past said stationary loading means, and said means for rotating said arbor of each of said work stations including pinion gear means fixed with each of said arbors and stationary rack gear means disposed for meshing engagements with said pinion gear means to cause rotations thereof and of said arbors as said work stations are rotated for a predetermined arcuate distance about said central axis.

10. Apparatus for the manufacture of helical coils as set forth in claim 9 further comprising cooperating movable cam means fixed angularly with each of said arbors and stationary cam means disposed for engagement by and angular positioning of each of said movable cam means after its work station has traversed said predetermined arcuate distance and until a fresh blank is ready to be clamped and locked with its work station, whereby said clamping means at each of said stations is oriented angularly in a predetermined position for clamping one end of a blank when passing said loading means.

11. Apparatus for the manufacture of helical coils as set forth in claim 9 wherein said loading means includes a conveyor for a stack of the blanks, and means for ejecting the blanks one at a time and positioning each ejected blank for engagements by said clamping means at one end and by said locking means at the other end as each work station is rotated to present its arbor at the site of said loading means.

* * * * *